United States Patent [19]

Achille

[11] Patent Number: 4,860,450

[45] Date of Patent: Aug. 29, 1989

[54] SURFACE STRIPPER

[75] Inventor: Geoffrey D. Achille, London, England

[73] Assignee: Asdren Limited, Braintree, England

[21] Appl. No.: 82,642

[22] PCT Filed: Nov. 26, 1986

[86] PCT No.: PCT/GB86/00720

§ 371 Date: Jul. 24, 1987

§ 102(e) Date: Jul. 24, 1987

[87] PCT Pub. No.: WO87/03253

PCT Pub. Date: Jun. 4, 1987

[30] Foreign Application Priority Data

Nov. 27, 1985 [GB] United Kingdom ..... 8529158

[51] Int. Cl.[4] ..... B26B 3/00

[52] U.S. Cl. ..... 30/172; 15/236.07; 15/236.1; 30/169; 30/347

[58] Field of Search ..... 30/169, 172, 170, 171, 30/347; 15/236 B, 236 C

[56] References Cited

U.S. PATENT DOCUMENTS 4,295,274 10/1981 Bricher et al. ..... 30/347

4,592,108 6/1986 Svendsen ..... 30/172

*Primary Examiner*—Douglas D. Watts

*Attorney, Agent, or Firm*—Roth & Goldman

[57] ABSTRACT

A stripping device for wall coverings such as wallpaper comprising a hand-held casing (1) housing an electric motor, a gearbox (2) driving an output boss (3) on which is mounted a concave cutting blade (4) having a peripheral cutting edge. The gearbox (2) is such as to cause the blade (4) to execute an orbital motion in the general plane of the disc. The device is used by pressing the blade (4) gently against the surface to be stripped whereupon the orbital motion in the plane of the surface causes the covering to be stripped.

23 Claims, 10 Drawing Sheets

SURFACE STRIPPER

This invention relates to a surface stripping device. Although primarily intended as a stripping device for wall coverings such as wallpaper, it is envisaged that the device could have a variety of uses such as for paint or varnish stripping, stripping of floor covering such as vinyl tiles, general descaling operations in industry, removal of road surfaces prior to resurfacing and in boat antifouling.

According to the invention the device comprises a blade in the form of a generally circular disc having one or more cutting edges around its periphery, together with means for causing said disc to undertake an orbital motion in a plane generally parallel to the general plane of the disc.

The blade may be circular, defining a single circular cutting edge, or multi-sided (for example, 12 sided), thus defining a plurality of straight cutting edges. The cutting action may be enhanced by specially treating the edge: for example by serrating it, or by forming a burr on it, or both.

The blade is mounted for use on a drive unit capable of providing the required orbital motion. Such units are already known and are used, for example, to power orbital sanders. Generally such units comprise an electric motor housed within a generally cylindrical casing having a handle which in use is gripped by the operator. A gearbox is used to convert the rotary output from the motor into an orbital motion, this usually involving a turn through 90°. Thus, the general plane of the blade is parallel to the axis of the cylindrical casing.

The blade may be rigidly mounted on the drive unit, but in practice is preferably flexibly mounted since this assists the operator in not penetrating the surface during stripping, which can happen if the blade is not kept parallel to the surface. Thus, the blade may be tightened against a rubber or similar flexible washer, or the drive may incorporate a rubber "cush drive" which both reduces vibration and allows a considerable degree of blade movement relative to the power unit. A spring mounting could also be used, using a helical coil spring to transmit the drive.

This problem of penetration of the surface during stripping may also be reduced by segmenting the blades as this increases the flexibility of the blade itself. This segmenting may be achieved by forming a plurality of radial slots extending towards the center of the blade from the periphery. In a multi-sided blade, each segment can be separated from the rest by such a slot. The slots are typically 1 mm wide.

The blades may be made from steel, for example stainless steel, or plastics material. The general flexibility of the blades may however be improved by manufacturing them from flexible material such as spring steel, or even hard plastics materials such as polycarbonates. The periphery of the blade may be hardened, to improve wear, or may be faced with carbide to provide a cutting edge having a long life expectancy.

The use of flexible blades enables a reciprocatory action to be applied to the blade, as well as the orbital motion described above. Such reciprocatory action would be in a direction at right angles to the general plane of the disc. This effectively means that the orbital motion, instead of being in a single plane, is in a plane which reciprocates backwards and forwards towards and away from the wall surface being stripped. Flexible blades can take up this movement and, indeed, will benefit by additionally cutting as radial movement of the blade periphery takes place.

In order that the invention may be better understood several embodiments thereof will now be described by way of example only and with reference to the accompanying drawings in which.

Figure 1:
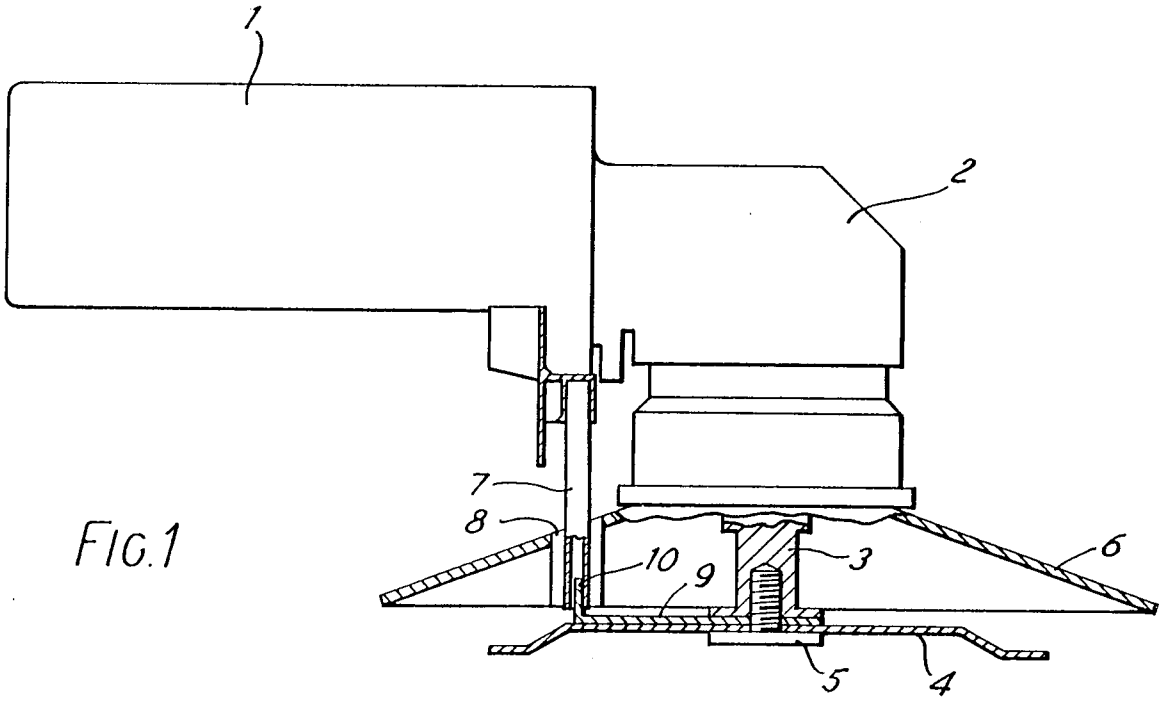
FIG. 1 is a diagrammatic side view of a stripping device according to the invention.

Referring to FIG. 1 there is shown a typical stripping device made in accordance with the invention. The device comprises a generally cylindrical casing 1 which contains an electric motor and supplies drive to a gearbox 2. The gearbox turns the drive through 90° and converts the rotary output of the motor into an orbital action in a plane at right angles to that of the drawing. Such gearboxes are well known and will not be described in detail; suffice to say that, with the motor switched on, the output boss 3 executes an orbital motion in a plane at right angles to that of the drawing. Switch means (not shown) are provided for switching the motor on and off. In use, the user may grip the casing 1 or, in larger sizes, an integral handle may be provided.

Attached to the boss 3 is a blade 4 in the form of a generally circular disc which has one or more cutting edges at its periphery. Various designs of blade are to be discussed hereinafter in detail. The disc has a central aperture by which it is located on the boss 3 by means of a bolt 5.

When the motor is energised the disc executes an orbital motion in a plane at right angles to the drawing. In order to use the device, the operator places the blade flat against the surface to be stripped and the orbital motion of the blade in the plane of the wall rapidly strips off the covering. The device may be used wet or dry.

It will be seen that a certain degree of flexibility in the blade is advantageous in reducing the possibility of digging in to the surface. Some designs for flexible blades are to be discussed. Alternatively or in addition, the blade may be mounted flexibly with respect to the drive unit. This may be achieved by making the boss 3 of tough flexible material such as rubber in the manner of a "cush" drive or simply by making the boss of steel, aluminium, or the like and fitting a washer of flexible material such as plastics or rubber between the blade and the boss.

A conical guard 6 made for example of plastics material is attached to the gearbox housing and protects the operator from the blade. The presence of the guard also acts to prevent the blade being tipped too far from its desired operating position parallel to the surface, and thus additionally acts to prevent surface damage through careless use of the device.

The orbital motion which the blade undertakes when the device is in use is produced by a conventional mechanism which will not be described in detail. Some types of such mechanism cause the blade to rotate or precess, as well as orbiting and this action may be desirable in some circumstances. In order to prevent this rotation, particularly on start-up, means may be provided for inhibiting rotation of the blade, and one way of achieving this is shown in FIG. 1. The mechanism comprises a coil spring 7 which is attached at one end to the casing 1 and extends parallel to the axis of the blade, through an aperture 8 in the guard 6 to end immediately behind the blade 4. A lever 9 is attached behind the blade and has a small lug 10 which enters the end of the spring. A similar effect can be obtained by striking the lug 10 out of the material of the blade itself.

The effect of this arrangement is to allow the orbital motion of the blade to continue unhindered, but to inhibit rotation of the blade. Due to the flexibility of the spring the blade is allowed to rotate through a small arc, but cannot rotate continuously. A reciprocatory rotary motion about a small arc thus results, this motion being on top of the main orbital motion.

Figure 16:
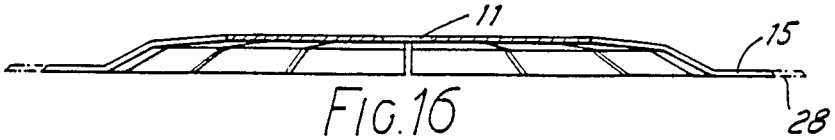
Figure 17:
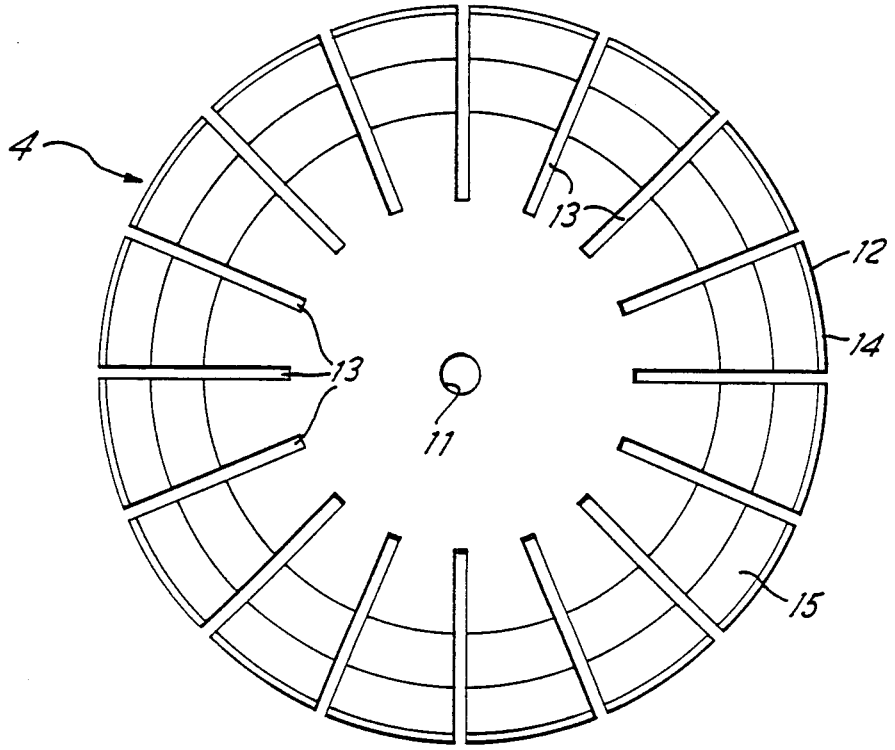
FIGS. 17, 18 and 19 are views corresponding to FIGS. 11, 12 and 13 respectively, showing a sixth embodiment.
Figure 18:
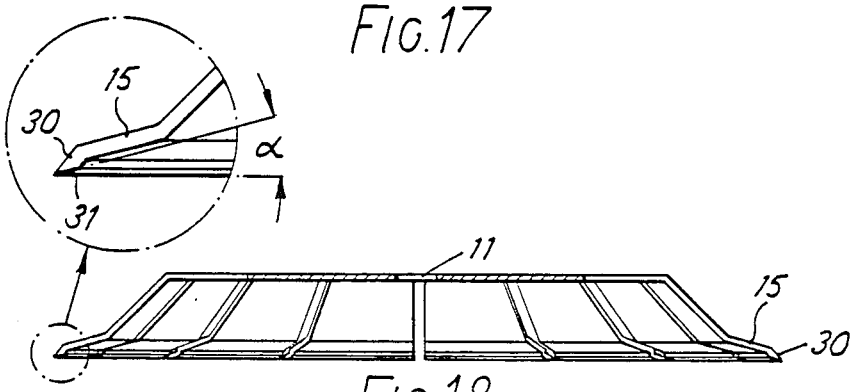
Figure 19:
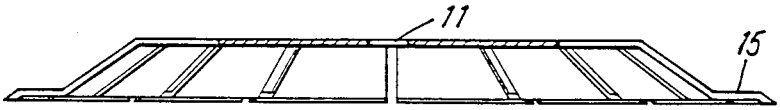

There will now be described various configurations of blade 4 which can be used with the stripper described above. The first three blades to be described with reference to FIGS. 2 to 10 are made from relatively rigid material such as 22 gauge steel or hard plastics material; those described with reference to FIGS. 11 to 16 are made from flexible material such as spring steel; FIG. 17 shows a combination blade and FIGS. 18 and 19 show a blade system comprising a holder and annular blade.

Figure 2:
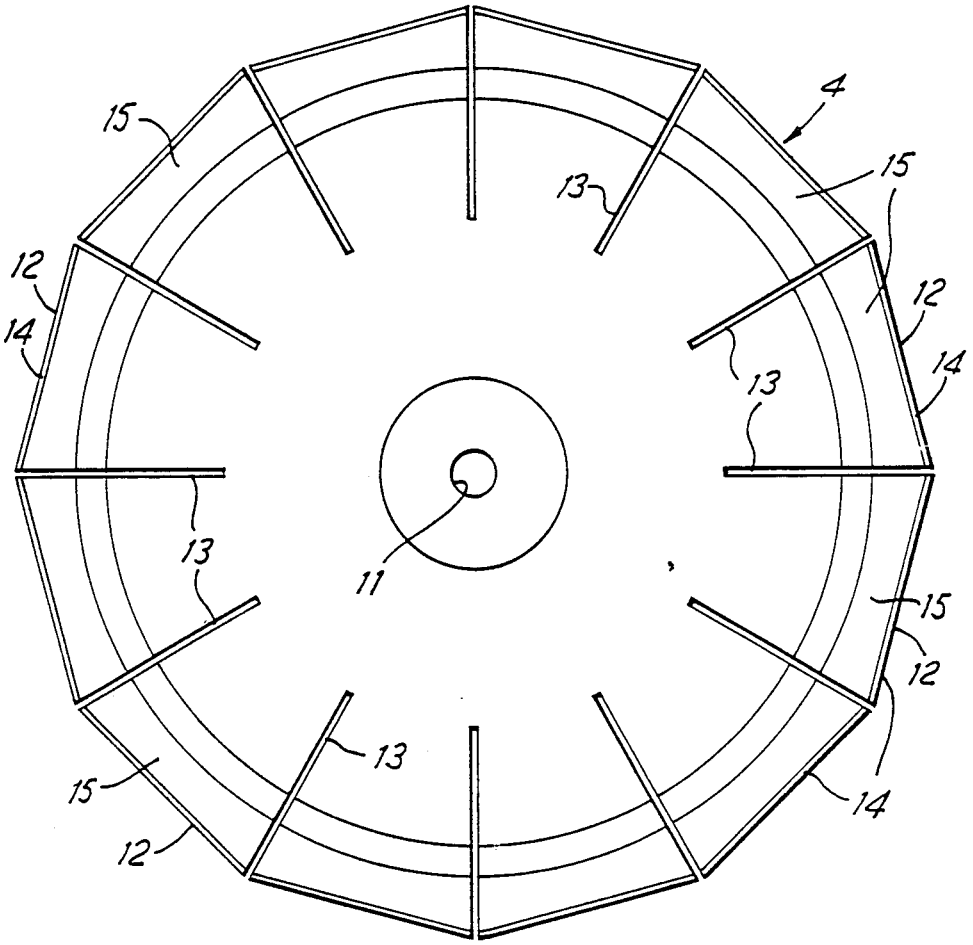
FIGS. 2, 3 and 4 are plan, side section and sectional detail respectively of a first embodiment of a blade for use with the stripping device of the invention.
Figure 3:
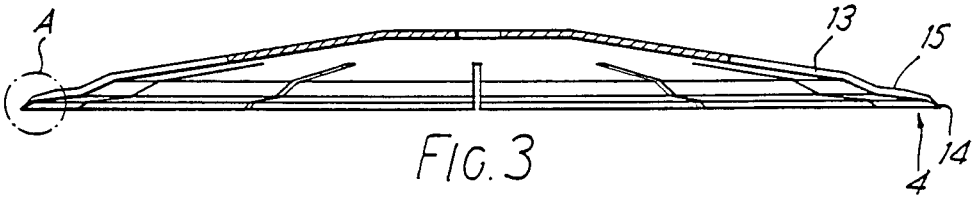
Figure 4:
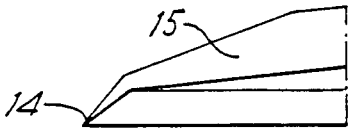

Referring firstly to FIGS. 2, 3 and 4 there is shown a twelve-sided blade 4 having a generally concave profile shaped as shown in FIG. 3. A central aperture 11 is used to mount the blade on the boss 3 as described above. The blade typically has a diameter of approximately 150 mm. Each straight cutting edge 12 is separated from its neighbour by a radially inwards-directed slot 13, typically of 1 mm width.

FIG. 4 shows enlarged detail of the cutting edge, encircled A in FIG. 3. It will be seen that the edge is ground or otherwise formed to a 15° cutting angle and is formed with a continuous burr 14. Typically the burr protrudes downwards by approximately 0.254 mm. Immediately behind the blade is a peripheral land 15 of generally annular shape and typically of 10 mm width. This land is important in operation since it represents a largish flat surface which can be pressed against the wall reasonably firmly without fear of damaging the wall. The land prevents the blade from entering or piercing the surface being stripped by virtue of its surface area; meanwhile, because the burr is substantially smaller than the land, it (the burr) will penetrate the surface covering to enable removal of same, the depth of such penetration being limited by the adjacent land.

The segmenting of the blade by means of the slots 13 enables the individual segments to act independently of one another on an uneven surface.

Figure 5:
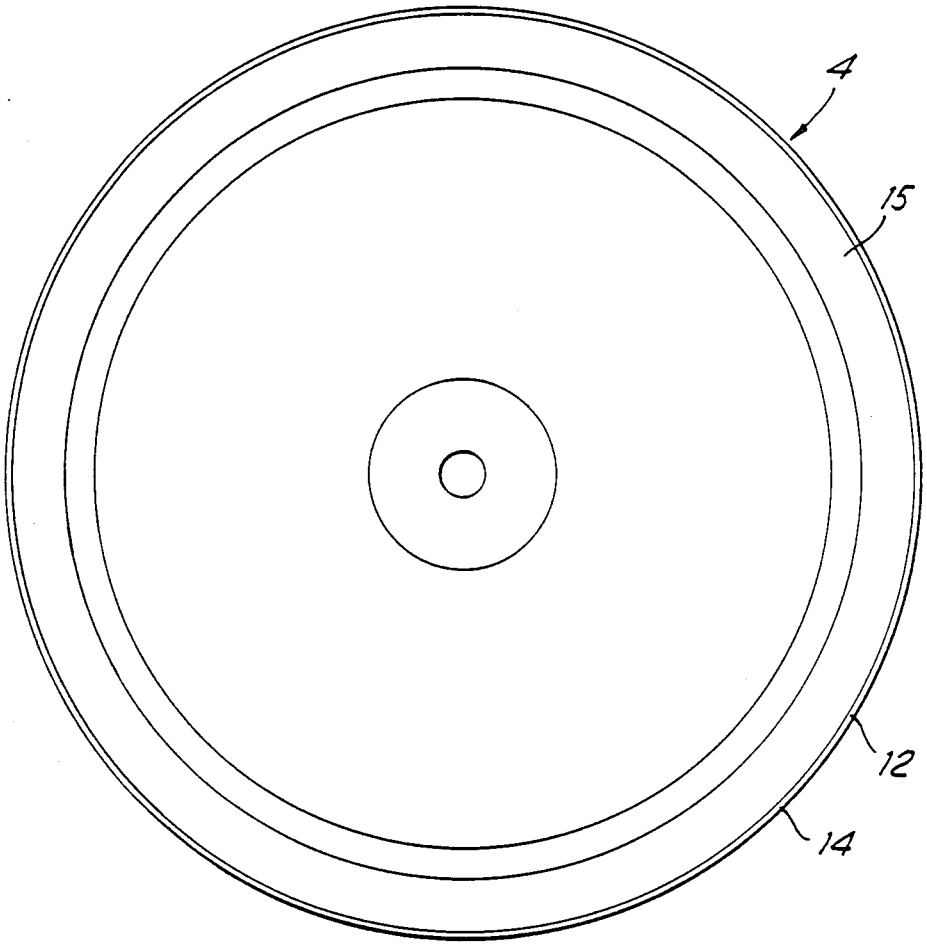
FIGS. 5, 6 and 7 are views corresponding to FIGS. 2, 3 and 4 respectively showing a second embodiment.
Figure 6:
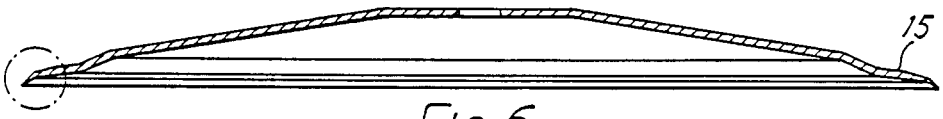
Figure 7:
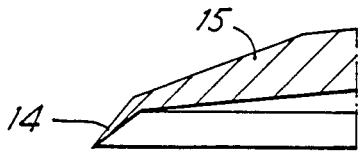

FIGS. 5, 6 and 7 show a blade similar to that just described but which is circular with a burred cutting edge 12 around its perimeter in the manner described previously.

This is a general-purpose blade useful for stripping a variety of wall coverings such as wallpaper, paint or ARTEX from flat regular wall or ceiling surfaces.

Figure 8:
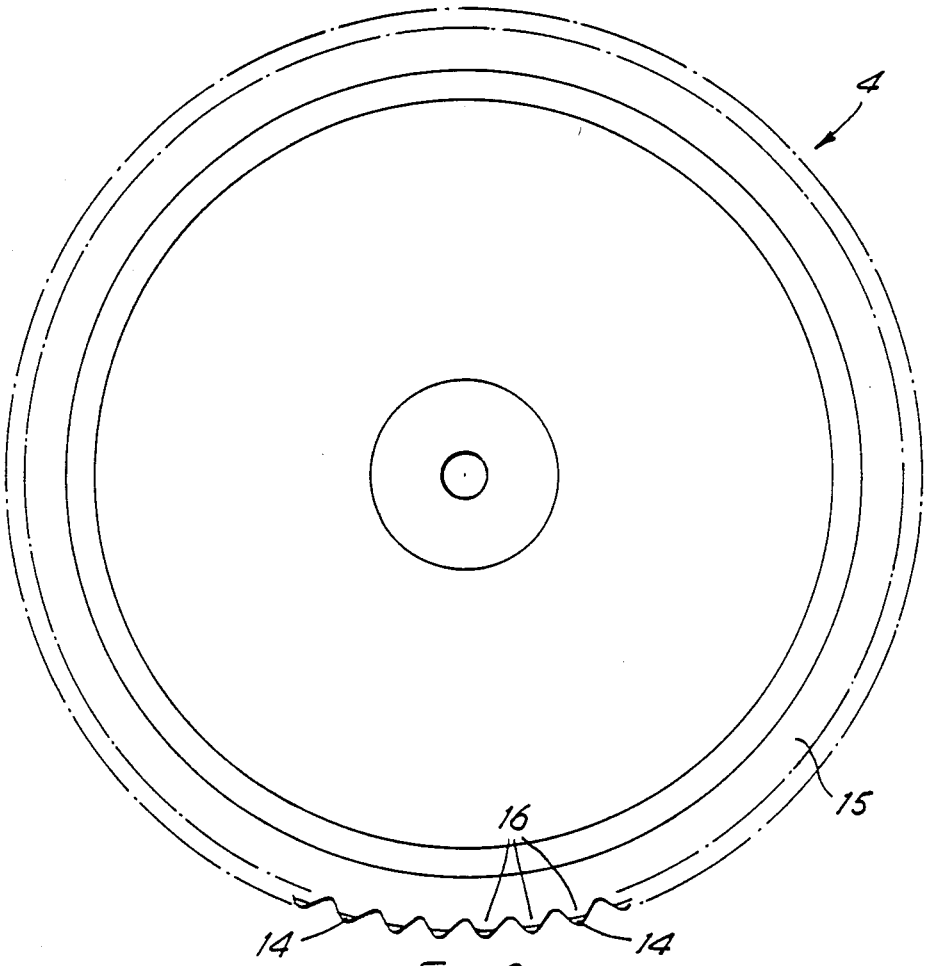
FIGS. 8, 9 and 10 are views corresponding to FIGS. 2, 3 and 4 respectively, showing a third embodiment.
Figure 9:
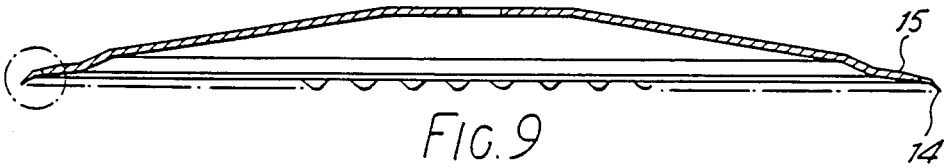
Figure 10:
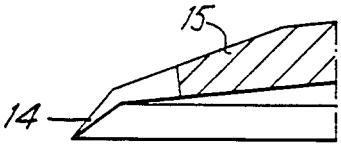
Figure 11:
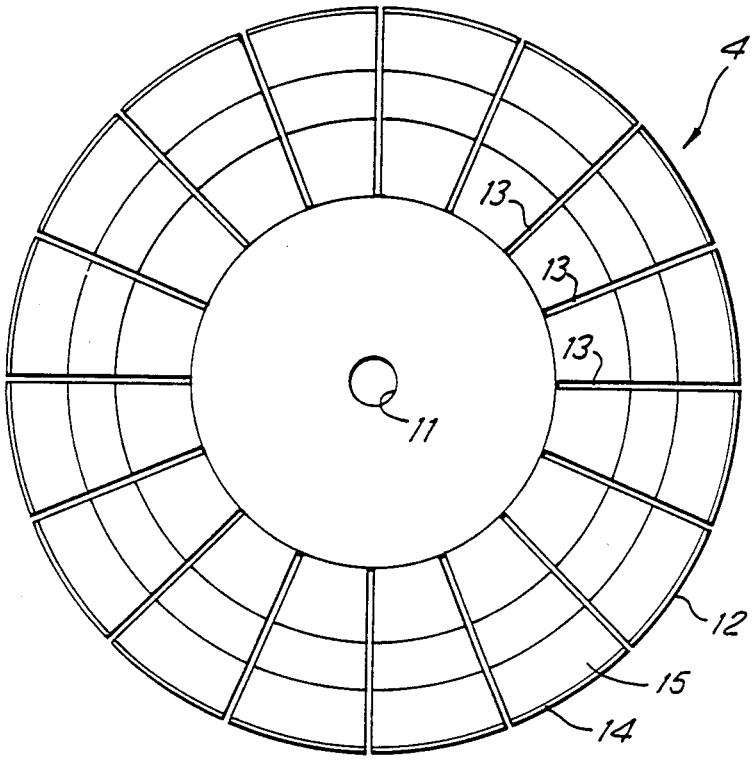
FIG. 11 is a plan view of a fourth embodiment of a blade for use with the stripping device of the invention.

FIGS. 8, 9 and 10 show another blade similar to that of FIGS. 1, 2 and 3 but in which the peripheral edge is serrated. The number of serrations 16 can be varied, but is typically 64. As shown, each circular serration 16 has a burr of its own.

This blade is primarily intended for plasterlike wall coverings, such as ARTEX, but is also useful for scratching or pricking wallpapers prior to stripping if exceptional difficulty is experienced.

The two blades shown in FIGS. 11 to 13 and 14 to 16 will be described together as they are very similar. Both blades are intended to be highly flexible and, to this end, are made of spring steel or similar, and are formed with sixteen radial slots 13, each 2 mm wide. The only difference between the two blades is that the first (FIGS. 11 to 13) is left entirely circular, while the second (FIGS. 14 to 16) is formed into 16 straight sided cutting edges.

Figure 12:
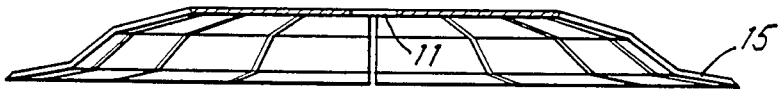
FIGS. 12 and 13 are side sections of the blade of FIG. 11 showing the manufactured profile of the blade (FIG. 12) and the working profile of the blade (FIG. 13)
Figure 13:
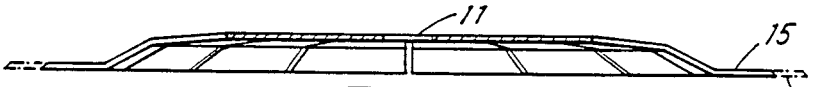
Figure 14:
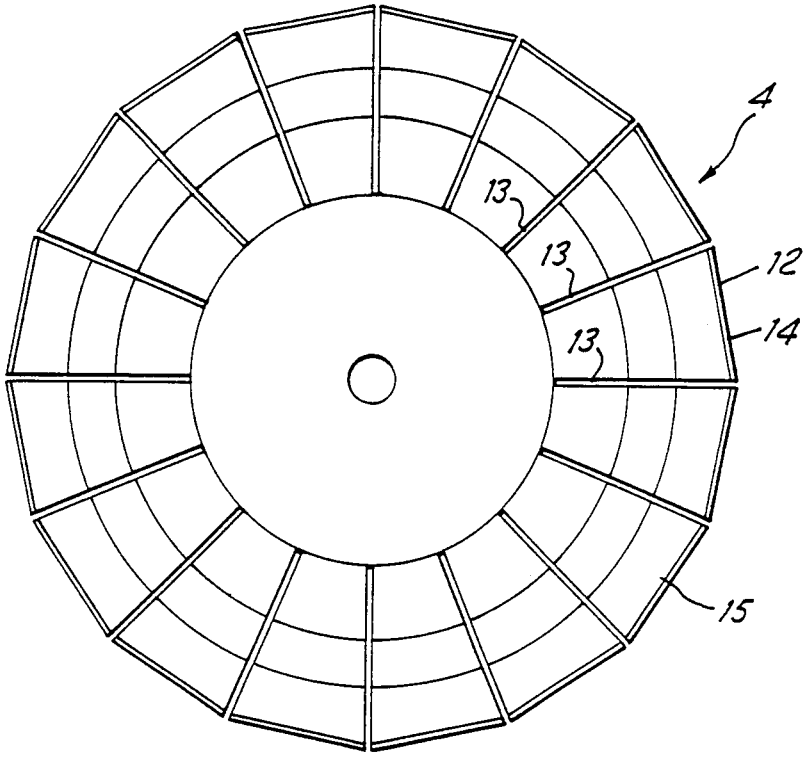
FIGS. 14, 15 and 16 are views corresponding to FIGS. 11, 12 and 13 respectively, showing a fifth embodiment.
Figure 15:
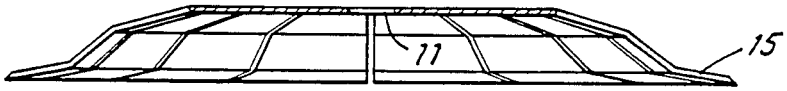

The flexibility of the blades is shown in FIGS. 12/13 and 15/16. In each case these represent the profile as manufactured (FIGS. 12 and 15) and the compressed working profile (FIGS. 13 and 16). These blades are typically 120 mm in diameter. As before the cutting edges are formed with a 15° cutting angle and continuous burr. A feature of these flexible blades is that the diameter increases as they are pushed towards the wall surface—this is represented by the dotted outline 28 in FIGS. 13 and 16. This increase in diameter enables an enhanced cutting action when the blade is moved backwards and forwards towards the surface, thus causing the diameter to increase and decrease.

The blade shown in FIGS. 17 to 19 is very similar to that described above with reference to FIGS. 11 to 13. The main differences are a slightly different sectional shape (see FIGS. 18 and 19), and a slightly different arrangement for forming the cutting edge, as shown in the enlarged section of FIG. 18. In this case, the peripheral land 15 terminates at the peripheral edge in a downwardly extending nose portion 30 extending around the perimeter. The bottom (i.e. surface-facing) surface of the one portion 30 is sharpened to give an undercut edge 31 defining a cutting angle $\alpha$ with the general plane of the blade. The angle $\alpha$ depends upon the particular covering to be stripped. Thus, the exact value of angle $\alpha$ will vary according to the anticipated circumstances of use, but angles in the range 16° to 34° have been found particularly successful for the normal range of wall coverings.

Figure 20:
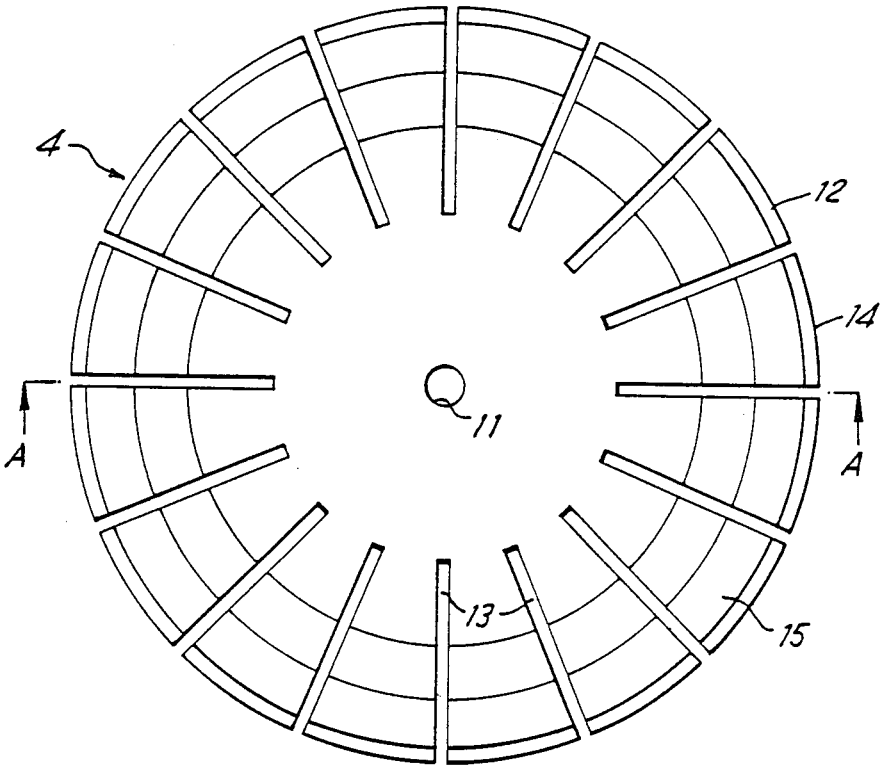
FIGS. 20 and 21 are views corresponding to FIGS. 11 and 12 respectively showing a seventh embodiment.
Figure 21:
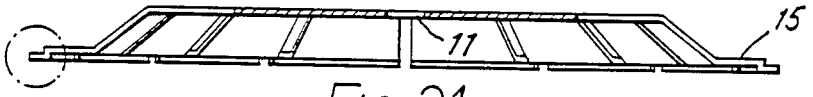
Figure 22:
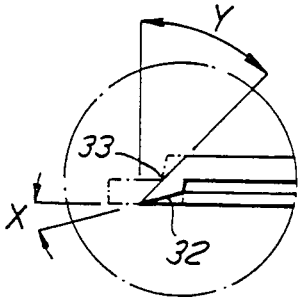
FIG. 22 is an enlarged sectional view of the cutting edge in the embodiment of FIGS. 20 and 21.

The blade shown in FIGS. 20 to 22 is again similar to that described above with reference to FIGS. 11 to 13, but with a double-ground cutting edge shown in detail in FIG. 22. The cutting edge is actually formed by two ground surfaces 32,33, defining respective angles X and Y, as shown. Angles X and Y may each range between 0° and 60°, but a typical practicable range is: angle X between 26° and 40°; angle Y between 24° and 40°. It is found that increasing the angle X results in a faster cutting speed, but the blade is less able to cope with tough material. The square edge profile shown in FIG. 21 and in outline in FIG. 22 depicts the blade prior to grinding. It will be noted also that the slope of the peripheral land 15 is zero in this embodiment. In practice, it is found that the slope of land 15 can vary between 0° and 45°.

Figure 23:
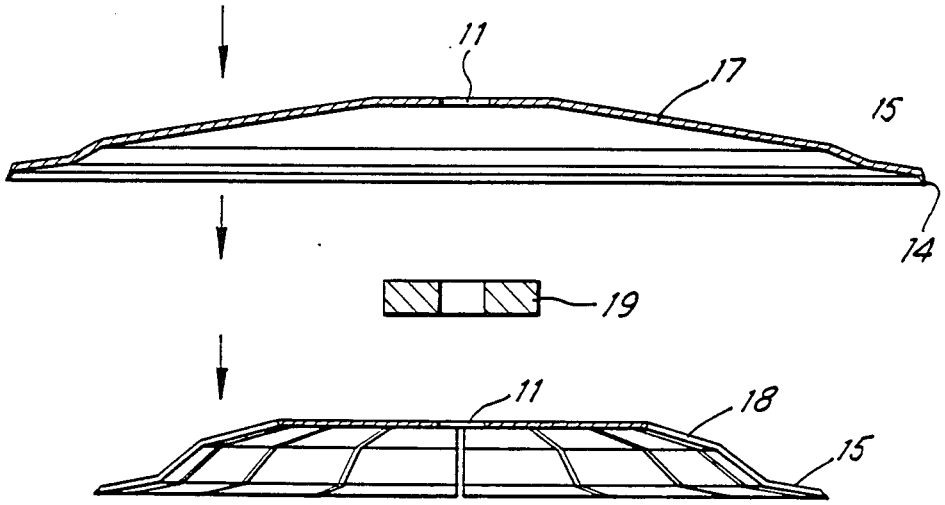
FIG. 23 is an exploded side sectional view of a combination blade for use with the stripping device of the present invention.

The blade shown in FIG. 23 is a combination blade comprising an upper blade 17 similar to the FIG. 5 blade described above and a lower blade 18 similar to the FIG. 14 blade described above. A spacer washer 19 separates the two.

Figure 24:
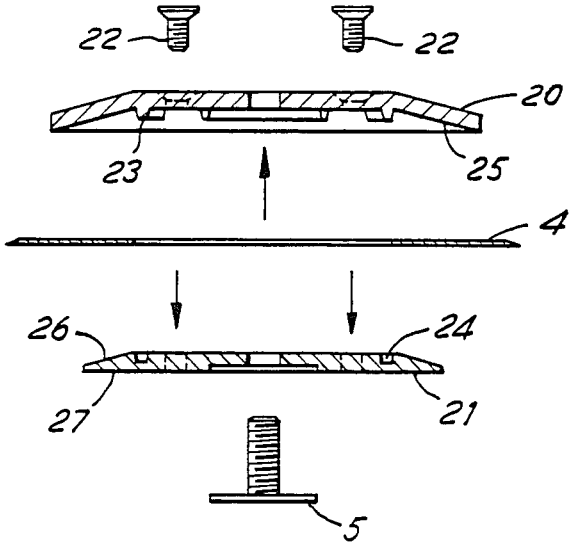
FIG. 24 is an exploded side sectional view of a rigidly mounted annular blade for use with the stripping device of the present invention.
Figure 25:
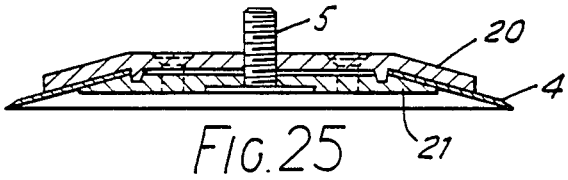
FIG. 25 is a side sectional view of the annular blade system of FIG. 24.
Figure 26:
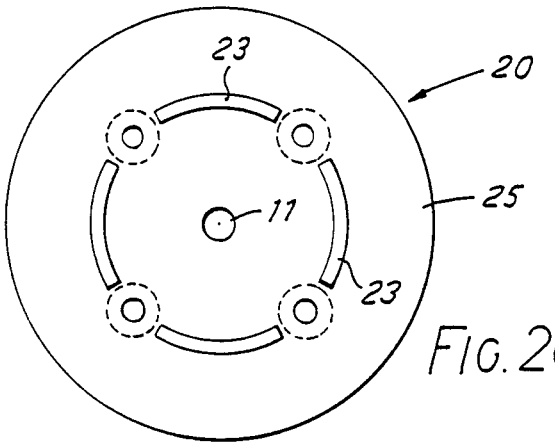
FIG. 26 is an underside view of part of the holding device for the annular blade of FIG. 24.

The blade shown in FIGS. 24 to 26 is actually a blade "system", comprising a blade itself (reference 4) and a two-part holder for the blade, which latter is attached to the boss 3 in the manner described above. As manufactured, the blade 4 is annular in shape and is planar, as shown in FIG. 24. The action of screwing the two parts 20, 21 of the holder together by means of screws 22 is to force the blade into a conical profile for cutting.

The underside of the upper part 20 of the holder is shown in FIG. 26 and will be seen to consist of a segmented circular ridge 23, and, upon assembly, this fits into a correspondingly shaped groove 24 in the lower part 21. The inner diameter of the blade 4 is such as to fit readily and locate over the outer edge of the ridge 23. Radially outwardly from the ridge 23, the underside surface 25 of the upper part 20 is conical, this corresponding to an equivalent conical top surface 26 of the lower part 21. Thus, when the two parts 20, 21 are brought together with the blade 4 inbetween, the blade is forced into a conical shape by virtue of being pressed between opposing surfaces 25 and 26—see FIG. 25.

The outer diameter of blade 4 is such that, when the parts 20 and 21 are fully tightened together, the perimeter of the blade protrudes below the undersurface 27 of the lower part 21 thus taking the place of the burr of previous embodiments. The perimeter edge of the blade may be sharpened to a razor edge, or may be formed in the same manner as the perimeter of the blade of FIG. 2 with a 15° ground edge and burr, or in the same manner as the blade of FIGS. 17 or 20.

Various modifications may be made to the device described above. For example, in order to enable the blades to be changed rapidly, a bayonet-type locking mechanism could be used to attach the blades to the boss 3.

I claim:

1. A surface stripping device, said device comprising a blade in the form of a generally circular disc with a generally concave profile having one or more cutting edges around its periphery, means for mounting said disc, driving means for causing said disc to undertake an orbital motion in a plane generally parallel to the general plane of the disc such that substantially the entire periphery of the cutting edge of said disc is in contact with the surface to be stripped when said device is in use, means for inhibiting rotary motion of the blade when said device is in use, and means for causing the disc to reciprocate through a small arc.

2. A stripping device as claimed in claim 1 wherein said drive means comprises an electric motor and gearbox, said gearbox being operable to convert the rotary output from said motor to an orbital motion.

3. A stripping device as claimed in claim 2 in the form of a portable power tool comprising a casing having a hand grip, and wherein said blade is mounted for orbital motion on said casing.

4. A stripping device as claimed in any one of claims 1 to 3 wherein said means for inhibiting rotary motion of the blade when the device is in use comprises said means for causing the disc to reciprocate through a small arc.

5. A stripping device as claimed in any one of claims 1 to 3 wherein the disc is circular and has a single cutting edge around its periphery.

6. A stripping device as claimed in any one of claims 1 to 3 wherein the disc is polygonal, each straight edge being formed with a cutting edge.

7. A stripping device as claimed in claim 5 wherein the disc is formed with a plurality of slots extending radially inwardly from the periphery in order to enhance the flexibility of the disc.

8. A stripping device as claimed in claim 5 wherein the disc is made of flexible material.

9. A stripping device as claimed in any one of claims 1 to 3 wherein the peripheral edge of the blade is serrated, and wherein each serration is formed with a cutting edge.

10. A stripping device as claimed in claim 5 wherein the or each cutting edge is formed with a burr extending in a direction towards a surface to be stripped when said device is in use.

11. A stripping device as claimed in claim 5 wherein the cutting edge is sharpened in such a way as to give an angled undercut edge defining an angle $\alpha$ with respect to the general plane of the blade.

12. A stripping device as claimed in claim 11 wherein the angle $\alpha$ lies in the range 16° to 34°.

13. A stripping device as claimed in any one of claims 1 to 3 wherein the disc is annular in shape and is held captive between a pair of rigid plates in such a way as to give the disc a conical profile.

14. A blade for a stripping device of the type claimed in any one of claims 1 to 3, said blade having one or more cutting edges around its periphery.

15. A blade as claimed in claim 14 wherein the disc is formed with a plurality of slots extending radially inwardly from the periphery in order to enhance the flexibility of the disc.

16. A blade as claimed in claim 14 wherein the disc is made of flexible material.

17. A blade as claimed in claim 14 wherein the or each cutting edge is formed with a burr extending downwards in a direction towards a surface to be stripped when in use.

18. A stripping device as claimed in claim 6 wherein the disc is formed with a plurality of slots extending radially inwardly from the periphery in order to enhance the flexibility of the disc.

19. A stripping device as claimed in claim 6 wherein the disc is made of flexible material.

20. A stripping device as claimed in claim 6 wherein the or each cutting edge is formed with a burr extending in a direction towards a surface to be stripped when said device is in use.

21. A stripping device as claimed in claim 9 wherein the or each cutting edge is formed with a burr extending in a direction towards a surface to be stripped when said device is in use.

22. A stripping device as claimed in claim 6 wherein the cutting edge is sharpened in such a way as to give an angled undercut edge defining an angle $\alpha$ with respect to the general plane of the blade.

23. A stripping device as claimed in claim 9 wherein the cutting edge is sharpened in such a way as to give an angled undercut edge defining an angle $\alpha$ with respect to the general plane of the blade.

* * * * *